US008360018B2

(12) United States Patent
Sato et al.

(10) Patent No.: US 8,360,018 B2
(45) Date of Patent: Jan. 29, 2013

(54) V-TYPE INTERNAL COMBUSTION ENGINE WITH VARIABLE VALVE TRAIN

(75) Inventors: Toshiyuki Sato, Saitama (JP); Masoki Cho, Saitama (JP); Takahiro Imafuku, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 433 days.

(21) Appl. No.: 12/721,726

(22) Filed: Mar. 11, 2010

(65) Prior Publication Data

US 2010/0242871 A1 Sep. 30, 2010

(30) Foreign Application Priority Data

Mar. 27, 2009 (JP) ..... 2009-080539
Mar. 27, 2009 (JP) ..... 2009-080540

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.39, 90.44; 74/569
See application file for complete search history.

(56) References Cited

U.S. PATENT DOCUMENTS 7,802,547 B2 * 9/2010 Inomoto et al. ..... 123/90.16

FOREIGN PATENT DOCUMENTS

JP 2004-190609 7/2004

* cited by examiner

*Primary Examiner* — Ching Chang
(74) *Attorney, Agent, or Firm* — Birch, Stewart, Kolasch & Birch, LLP

(57) ABSTRACT

A V-type internal combustion engine having a variable valve train for keeping the height of the internal combustion engine low. Disclosed is a V-type internal combustion engine with a variable valve train that uses an actuator to vary the phase/lift amount of camshafts. The actuator is mounted on head covers for each of a plurality of cylinder blocks arranged in a V-shape. The actuator is attached to a lateral surface positioned opposite the offset direction of the head covers. In an embodiment, the actuator is attached to a lateral surface of the head covers and positioned close to the inside of the V banks.

8 Claims, 9 Drawing Sheets

V-TYPE INTERNAL COMBUSTION ENGINE WITH VARIABLE VALVE TRAIN

CROSS-REFERENCE TO RELATED APPLICATIONS

The present application claims priority under 35 USC 119 to Japanese Patent Application No. 2009-080539 filed on Mar. 27, 2009 Japanese Patent Application No. 2009-080540 filed on Mar. 27, 2009 and the entire contents of which are hereby incorporated by reference.

BACKGROUND OF THE INVENTION

1. Field of the Invention

The present invention relates to a V-type internal combustion engine with a variable valve train that varies the phase/lift amount of a camshaft.

2. Description of Background Art

Some V-type internal combustion engines in which cylinder blocks are arranged in a V-shape have a variable valve train that varies the phase/lift amount of a camshaft. This variable valve train includes a drive cam that rotates together with the camshaft, a valve cam that rotates relative to the camshaft for opening/closing an engine valve, a link mechanism that transmits the valve driving force of the drive cam to the valve cam, a holder member that supports a fulcrum of the link mechanism and is capable of swinging around the camshaft, and a drive mechanism that swings the holder member to vary the fulcrum position of the link mechanism, and varies the phase/lift amount of the camshaft in accordance with a swing position of the fulcrum of the link mechanism. The variable valve train is driven by an actuator that is mounted above a head cover. See, for example, JP-A No. 2004-190609.

However, the use of the above-described previous configuration, in which the actuator for the variable valve train is mounted above the head cover, increases the height of the internal combustion engine, thereby making it difficult to mount the internal combustion engine in a motorcycle or other small-sized vehicle.

SUMMARY AND OBJECTS OF THE INVENTION

Accordingly, an object of an embodiment of the present invention is to address the problem with the above-described previous technology and provide a V-type internal combustion engine having a variable valve train that keeps the height of the internal combustion engine low.

To address the above problem, an embodiment of the present invention provides a V-type internal combustion engine with a variable valve train which uses an actuator to vary the phase/lift amount of a camshaft. The actuator is mounted on a head cover for each of a plurality of cylinder blocks arranged in a V-shape. The cylinder blocks are positionally offset from each other in the axial direction of the camshaft. The actuator is mounted on a lateral surface positioned opposite the offset direction of the head cover. In an alternative arrangement, the actuator is mounted on a lateral surface of the head cover and positioned close to the inside of the V banks.

In the above-described configuration, the actuator is mounted on the lateral surface of the head cover. Therefore, the actuator does not protrude above the head cover. This makes it possible to keep the height of the internal combustion engine low. Further, the cylinder blocks are positionally offset from each other in the axial direction of the camshaft, and the actuator is mounted on the lateral surface positioned opposite the offset direction of the head cover. This makes it possible to minimize the protrusion of the camshaft in the axial direction.

The V-type internal combustion engine with the variable valve train may be configured so that the actuator is an electric motor which is mounted on the head cover with the axis line of the electric motor positioned substantially parallel to the top surface of the head cover.

In the above-described configuration, the electric motor is positioned sideways relative to the head cover. This makes it possible to keep the height of the internal combustion engine low.

The variable valve train of the V-type internal combustion engine may include a drive cam which rotates together with the camshaft, a valve cam which rotates relative to the camshaft and opens/closes an engine valve, a link mechanism which transmits the valve driving force of the drive cam to the valve cam, a holder member which supports a fulcrum of the link mechanism and is capable of swinging around the camshaft, and a drive mechanism which swings the holder member to vary the fulcrum position of the link mechanism, and vary the phase/lift amount of the camshaft in accordance with a swing position of the fulcrum of the link mechanism.

Even when the above-described configuration is employed, the height of the internal combustion engine can be kept low by mounting the actuator on the lateral surface of the head cover. Further, the protrusion of the camshaft in the axial direction can be minimized by positionally offsetting the cylinder blocks from each other in the axial direction of the camshaft and mounting the actuator on the lateral surface positioned opposite the offset direction of the head cover. In addition, the axial protrusion of the camshaft can be minimized at the outside of the V banks of the internal combustion engine by positioning the actuator close to the inside of the V banks.

The drive mechanism of the V-type internal combustion engine with the variable valve train may include a ball screw, which is positioned over an intake camshaft and an exhaust camshaft, the intake side of the ball screw being threaded in one direction and the exhaust side of the ball screw being threaded in another direction; a slider, which is provided for both the intake side and the exhaust side and is capable of traveling along the ball screw; and a coupling link member, which is disposed between the slider and the holder member.

In the above-described configuration, the ball screw along which the slider travels is positioned over the intake camshaft and the exhaust camshaft. This makes it possible to keep the height of the internal combustion engine even lower.

According to an embodiment of the present invention, the actuator is mounted on the lateral surface of the head cover. Therefore, the actuator does not protrude above the head cover. This makes it possible to keep the height of the internal combustion engine low. Further, the cylinder blocks are positionally offset from each other in the axial direction of the camshaft, and the actuator is mounted on the lateral surface positioned opposite the offset direction of the head cover. This makes it possible to minimize the protrusion of the camshaft in the axial direction.

Further, the actuator is an electric motor that is mounted on the head cover with the axis line of the electric motor positioned substantially parallel to the top surface of the head cover. Therefore, the electric motor is positioned sideways relative to the head cover. This makes it possible to keep the height of the internal combustion engine low.

Furthermore, even when the employed configuration is such that the variable valve train includes the drive cam which rotates together with the camshaft, the valve cam which rotates relative to the camshaft and opens/closes the engine valve, the link mechanism which transmits the valve driving force of the drive cam to the valve cam, the holder member which supports the fulcrum of the link mechanism and is capable of swinging around the camshaft, and the drive mechanism which swings the holder member to vary the fulcrum position of the link mechanism, and varies the phase/lift amount of the camshaft in accordance with the swing position of the fulcrum of the link mechanism, it is possible to prevent the actuator from protruding above the head cover and keep the height of the internal combustion engine low by mounting the actuator on the lateral surface of the head cover. Further, the protrusion of the camshaft in the axial direction can be minimized by positionally offsetting the cylinder blocks from each other in the axial direction of the camshaft and mounting the actuator on the lateral surface positioned opposite the offset direction of the head cover. In addition, in an embodiment of the present invention the axial protrusion of the camshaft can be minimized at the outside of the V banks of the internal combustion engine by positioning the actuator close to the inside of the V banks.

Moreover, the drive mechanism includes the ball screw, which is positioned over the intake camshaft and the exhaust camshaft, the intake side of the ball screw being threaded in one direction and the exhaust side of the ball screw being threaded in another direction; the slider, which is provided for both the intake side and the exhaust side and is capable of traveling along the ball screw; and the coupling link member, which is disposed between the slider and the holder member. Thus, the ball screw along which the slider travels is positioned over the intake camshaft and the exhaust camshaft. This makes it possible to keep the height of the internal combustion engine even lower.

In an embodiment of the above-described configuration, the actuator is mounted on the lateral surface of the head cover. Therefore, the actuator does not protrude above the head cover. This makes it possible to keep the height of the internal combustion engine low. Further, the actuator is positioned close to the inside of the V banks. This makes it possible to minimize the axial protrusion of the camshaft at the outside of the V banks of the internal combustion engine. In addition, a mass concentration occurs because the actuator is positioned close to the inside of the V banks. This, for example, provides a motorcycle rider with an improved steering feeling.

The V-type internal combustion engine with the variable valve train may be configured so that the cylinder blocks are positionally offset from each other in the axial direction of the camshaft while the actuator is mounted on a lateral surface positioned opposite the offset direction of the head cover.

In the above-described configuration, the cylinder blocks are positionally offset from each other in the axial direction of the camshaft while the actuator is mounted on a lateral surface positioned opposite the offset direction of the head cover. This makes it possible to minimize the axial protrusion of the camshaft.

Even when the above-described configuration according to an embodiment of the present invention is employed, the height of the internal combustion engine can be kept low by mounting the actuator on the lateral surface of the head cover. Further, the axial protrusion of the camshaft can be minimized by positionally offsetting the cylinder blocks from each other in the axial direction of the camshaft and mounting the actuator on the lateral surface positioned opposite the offset direction of the head cover. In addition, the axial protrusion of the camshaft can be minimized at the outside of the V banks of the internal combustion engine by positioning the actuator close to the inside of the V banks.

According to an embodiment of the present invention, the actuator is mounted on the lateral surface of the head cover. Therefore, the actuator does not protrude above the head cover. This makes it possible to keep the height of the internal combustion engine low. Further, as the actuator is positioned close to the inside of the V banks, the axial protrusion of the camshaft can be minimized at the outside of the V banks of the internal combustion engine. When, for instance, a pair of front and rear banks are provided, it is possible to prevent the actuator for the rear bank from interfering with a knee of a motorcycle rider. In addition, as the actuator is positioned close to the inside of the V banks, a mass concentration occurs, for instance, to provide the motorcycle rider with an improved steering feeling.

The cylinder blocks are positionally offset from each other in the axial direction of the camshaft, and the actuator is mounted on the lateral surface positioned opposite the offset direction of the head cover. This makes it possible to minimize the axial protrusion of the camshaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A preferred embodiment of the present invention will now be described with reference to the accompanying drawings. In the subsequent description, all references to direction (front, rear, left, right, up, and down) are made in relation to the body of a vehicle.

Figure 1:
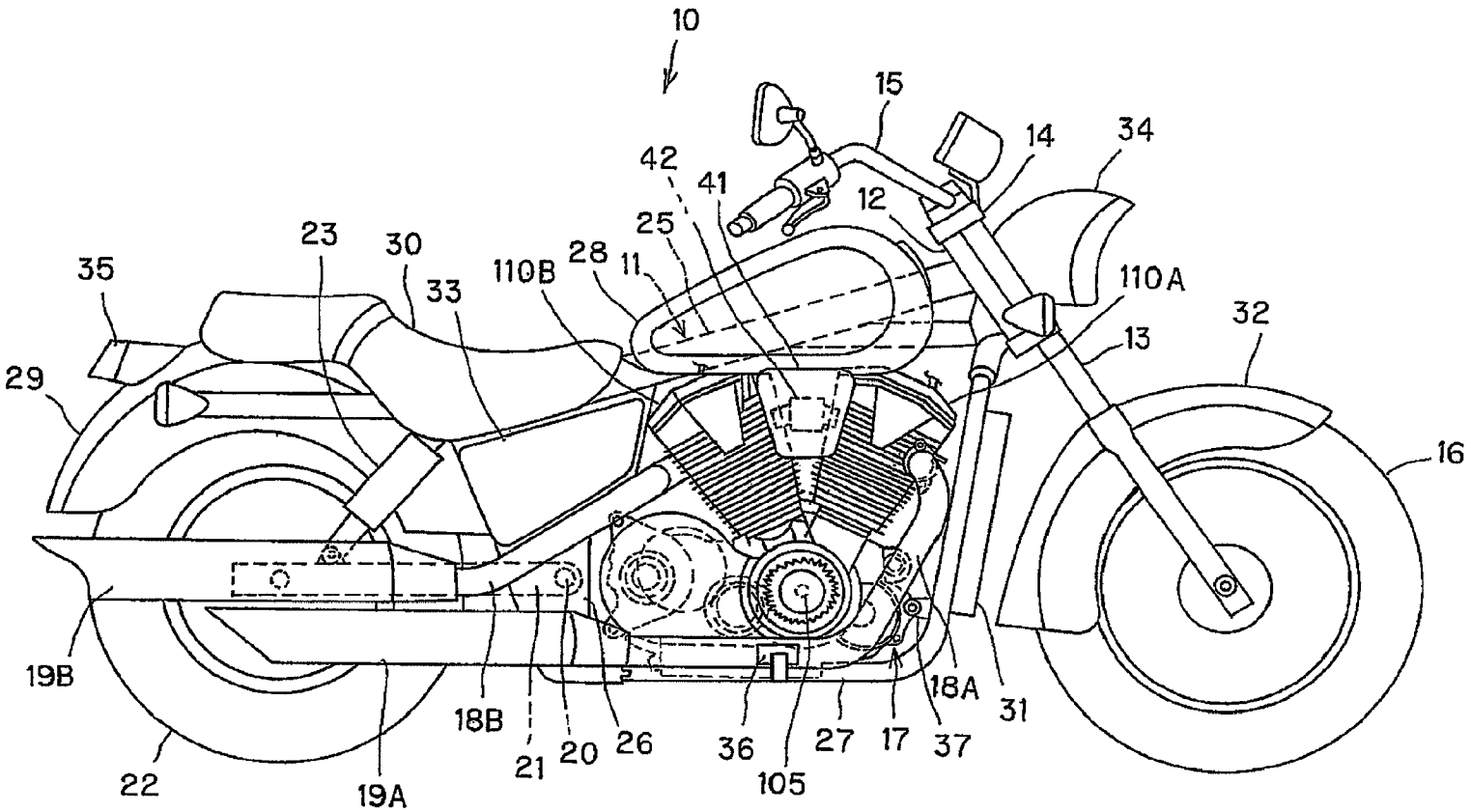
FIG. 1 is a side view illustrating a motorcycle in which an engine according to an embodiment of the present invention is mounted.

FIG. 1 is a side view illustrating a motorcycle to which an engine according to an embodiment of the present invention is applied. The motorcycle 10 includes a vehicle body frame 11, a pair of left-hand and right-hand front forks 13 which are turnably supported by a head pipe 12 mounted on the front end of the vehicle body frame 11, a steering handlebar 15 mounted on a top bridge 14 which supports the upper end of the front forks 13, a front wheel 16 which is rotatably supported by the front forks 13, an engine 17 which is a V-type internal combustion engine with a variable valve train and supported by the vehicle body frame 11, exhaust mufflers 19A, 19B which are coupled to the engine 17 through exhaust pipes 18A, 18B, a rear swing arm 21 which is vertically swingably supported by a pivot 20 on the rear lower part of the vehicle body frame 11, and a rear wheel 22 which is rotatably supported by the rear end of the rear swing arm 21. A rear shock absorber 23 is disposed between the rear swing arm 21 and vehicle body frame 11.

The vehicle body frame 11 includes a main frame 25 which extends from the head pipe 12 and is inclined downward toward the rear, a pair of left-hand and right-hand pivot plates (also referred to as the center frames) 26 which are coupled to the rear of the main frame 25, and a down tube 27 which is bent after extending downward from the head pipe 12 and extends and is coupled to the pivot plates 26. A fuel tank 28 is supported astride the main frame 25. The rear of the main frame 25 extends above the rear wheel 22 to support a rear fender 29. A seat 30 is supported between the upper side of the rear fender 19 and the fuel tank 28. In FIG. 1, a radiator 31 is supported by the down tube 27 with a front fender 32, a side cover 33, a headlight 34, a taillight 35 and an occupant step 36 being provided.

The engine 17 is supported in a space enclosed by the main frame 25, pivot plates 26, and down tube 27. The engine 17 is a front-rear V-type, two-cylinder, water-cooled, four-cycle engine in which cylinders are longitudinally banked in a V configuration. The engine 17 is supported by the vehicle body frame 11 through a plurality of engine brackets 37 (only a limited part of an engine bracket is shown in FIG. 1) in such a manner that a crankshaft 105 is oriented in a left-right horizontal direction relative to the vehicle body. The motive power of the engine 17 is transmitted to the rear wheel 22 through a drive shaft (not shown) that is disposed to the left of the rear wheel 22.

The engine 17 is formed in such a manner that the angle between a front bank 110A and a rear bank 110B (this angle is also referred to as the bank angle) is smaller than 90 degrees (e.g., 52 degrees). Valve devices for the banks 110A, 110B are both formed in a four-valve, double overhead camshaft (DOHC) configuration.

An air cleaner 41 and a throttle body 42, which form an engine intake system, are disposed in a V-shaped space formed by the front bank 110A and rear bank 110B. The throttle body 42 operates so that air purified by the air cleaner 41 is supplied to the front bank 110A and rear bank 110B. The exhaust pipes 18A, 18B, which form an engine exhaust system, are respectively connected to the banks 110A, 110B. The exhaust pipes 18A, 18B are routed along the right-hand side of the vehicle body. The exhaust mufflers 19A, 19B are respectively connected to the rear ends of the exhaust pipes 18A, 18B. Exhaust gas is discharged through the exhaust pipes 18A, 18B and exhaust mufflers 19A, 19B.

Figure 2:
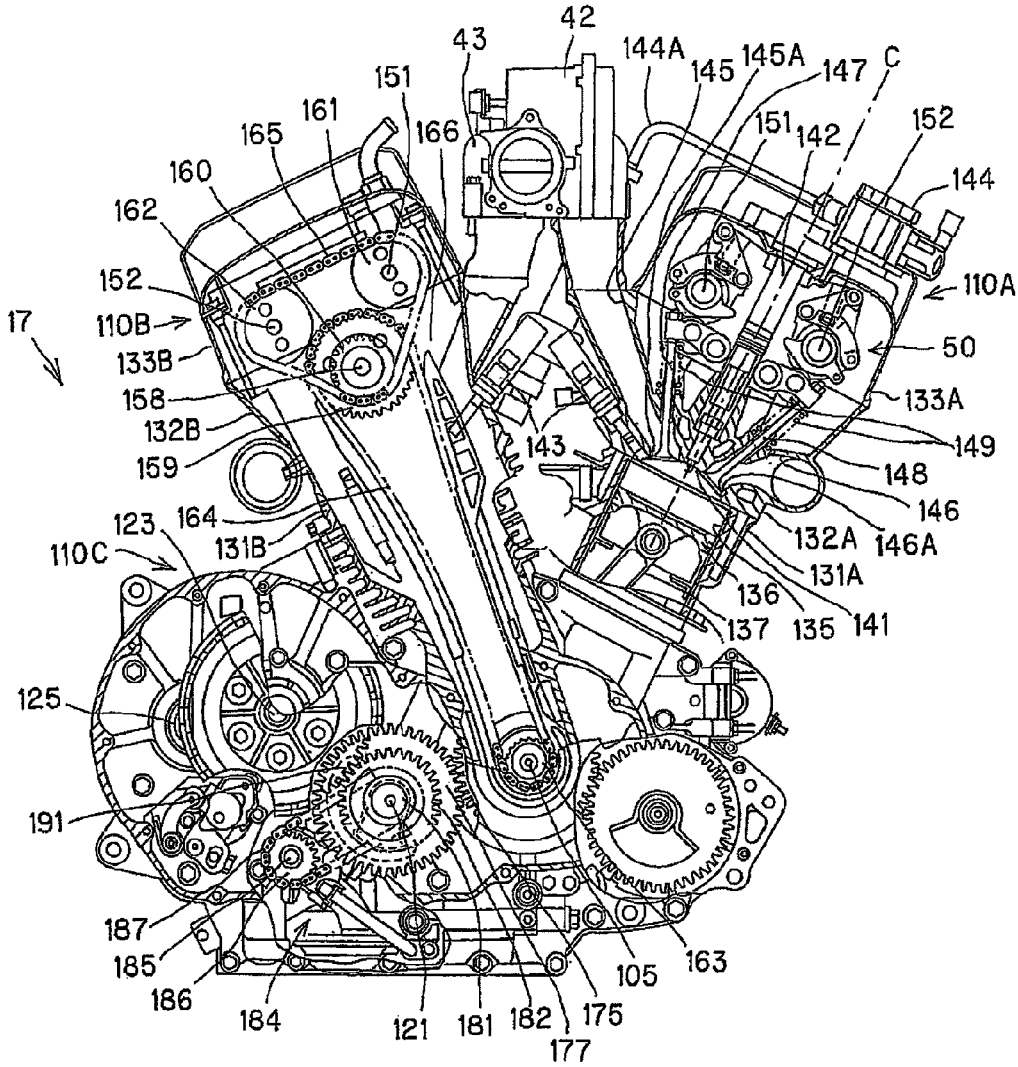
FIG. 2 is a side view illustrating the internal structure of the engine.
Figure 3:
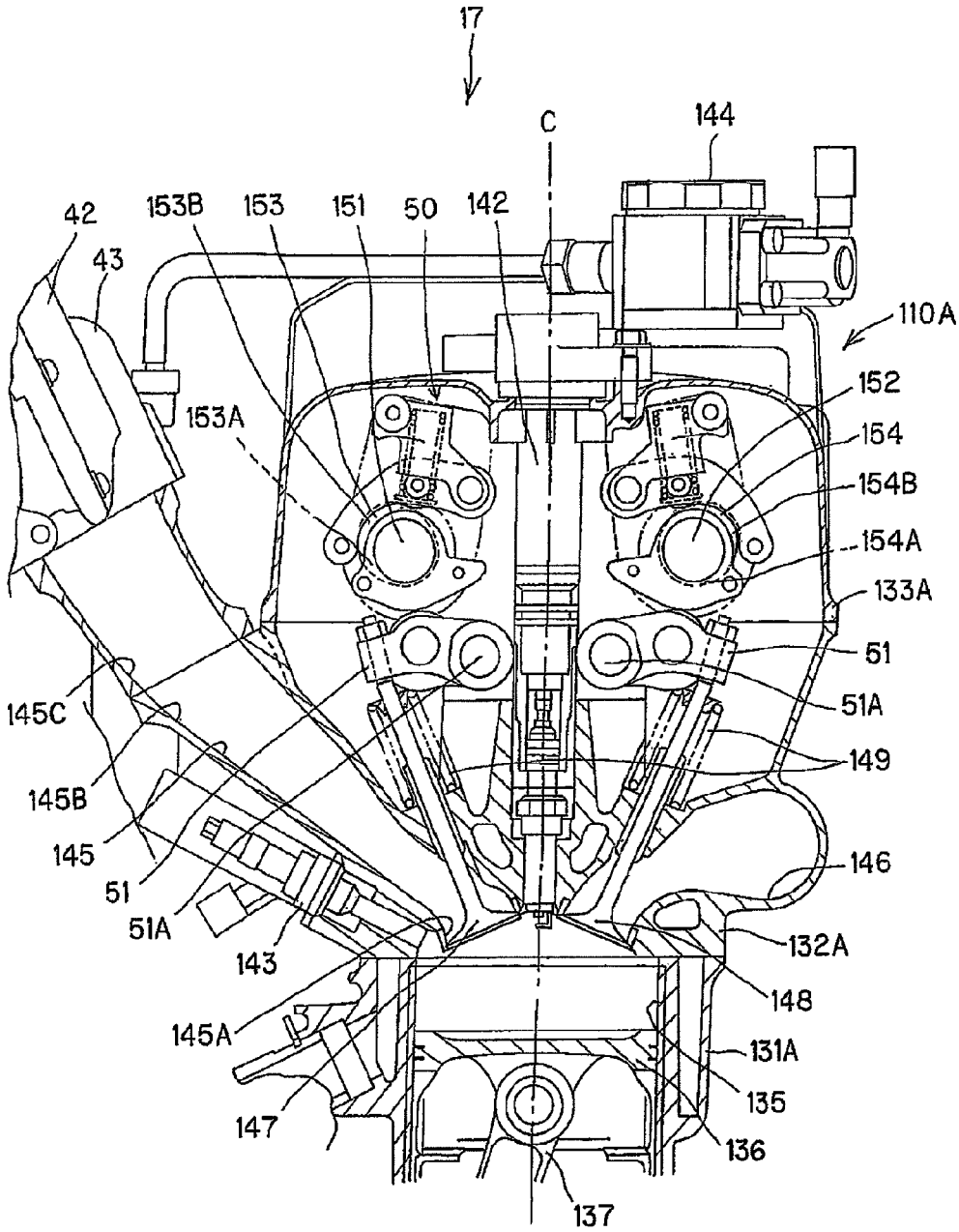
FIG. 3 is an enlarged side view illustrating the internal structure of a front bank shown in FIG. 2.

FIG. 2 is a side view illustrating the internal structure of the engine 17. FIG. 3 is an enlarged view illustrating the internal structure of the front bank 110A shown in FIG. 2.

Referring to FIG. 2, the front bank 110A and rear bank 110B of the engine 17 have the same structure. FIG. 2 shows a piston section of the front bank 110A and a cam chain section of the rear bank 110B. In FIG. 2, an intermediate shaft (rear balancer shaft) 121; a main shaft 123; and a countershaft 125 are provided. These shafts 121, 123, 125 and the crankshaft 105 are displaced from each other in the longitudinal and vertical directions of the vehicle body and positioned parallel to each other. In a crankcase 110C, which supports the above shafts, a gear transmission mechanism is formed to sequentially transmit the rotation of the crankshaft 105 to the intermediate shaft 121, main shaft 123, and countershaft 125.

As shown in FIG. 2, a front cylinder block 131A and a rear cylinder block 131B are disposed over the crankcase 110C of the engine 17. The front cylinder block 131A and rear cylinder block 131B are positioned to form a predetermined angle in the longitudinal direction of the vehicle body. A front cylinder head 132A and a rear cylinder head 132B are respectively coupled to the top surfaces of the cylinder blocks 131A, 131B. Further, head covers 133A, 133B are respectively installed over the cylinder heads 132A, 132B to form the front bank 110A and rear bank 110B.

Cylinder bores 135 are respectively formed in the cylinder blocks 131A, 131B. A piston 136 is slidably inserted into each cylinder bore 135. Each piston 136 is coupled to the crankshaft 105 through a connecting rod 137. As two connecting rods 137 for the front and rear banks 110A, 110B are coupled to the common crankshaft 105, the connecting rod 137 for the rear bank 110B is positioned to the left of the connecting rod 137 for the front bank 110A and adjacent to the left-hand side of the vehicle body.

A combustion concave section 141 is provided on the underside of each cylinder head 132A, 132B to form the top surface of a combustion chamber, which is formed above the piston 136. An ignition plug 142 is disposed with its leading end facing each combustion concave section 141. The ignition plug 142 is substantially coaxial with a cylinder axis line C.

The engine 17 is a direct injection engine, which injects fuel directly into the combustion chamber from an injector 143, which is installed in each combustion concave section 141. Each injector 143 is inserted from a V bank inner lateral surface of each cylinder head 132A, 132B and disposed with its leading end facing each combustion concave section 141. Each injector 143 is laid relative to the cylinder axis line C.

A fuel pump 144 is installed above the cylinder heads 132A. The fuel pump 144 supplies the fuel to each injector 143 through a fuel piping 144A.

An intake port 145 and an exhaust port 146 are formed in each cylinder head 132A, 132B. The intake port 145 communicates with each combustion concave section 141 through a pair of openings 145A, whereas the exhaust port 146 communicates with each combustion concave section 141 through a pair of openings 146A. The intake port 145 is positioned between the cylinder axis line C and injector 143.

As shown in FIGS. 2 and 3, each intake port 145 includes a lower intake port 145B, which is integral with the cylinder heads 132A, 132B, and an upper intake port 145C, which is separate from the cylinder heads 132A, 132B. The upper intake port 145C is angled to be closer to the head covers 133A, 133B than the lower intake port 145B.

The intake ports 145 converge at an intake chamber 43, which is coupled to the throttle body 42. The throttle body 42 employs a TBW (Throttle By Wire) system, which drives an actuator to vary the cross-sectional area of a throttle valve. The exhaust port 146 for the cylinder head 132A is coupled to the exhaust pipe 18A (see FIG. 1), whereas the exhaust port 146 for the cylinder head 132B is coupled to the exhaust pipe 18B (see FIG. 1).

A pair of intake valves 147 (engine valves) and a pair of exhaust valves 148 (engine valves) are disposed in the cylinder heads 132A, 132B. The intake valves 147 open and close the openings 145A in the intake ports 145, whereas the exhaust valves 148 open and close the openings 146A in the exhaust ports 146. Valve springs 149 apply a force to the intake valves 147 and exhaust valves 148 in the direction of closing the ports. The valves 147, 148 are driven by a valve device 50 (variable valve train), which is capable of changing the open/close timing, lift amount, and other valve operation characteristics. The valve device 50 is rotatably supported by the cylinder heads 132A, 132B, and includes intake and exhaust camshafts 151, 152, which rotate in synchronism with the rotation of the engine 17.

An intake cam 153 (drive cam) is integral with the camshaft 151. The intake cam 153 includes a base circle portion 153A, which forms a circular cam surface, and a cam lobe portion 153B, which projects from the base circle portion 153A to form a mountain-shaped cam lobe surface. An exhaust cam 154 (drive cam) is integral with the camshaft 152. The exhaust cam 154 includes a base circle portion 154A, which forms a circular cam surface, and a cam lobe portion 154B, which projects from the base circle portion 154A to form a mountain-shaped cam lobe surface.

As shown in FIG. 2, a middle shaft 158 is rotatably supported by one widthwise end of the cylinder heads 132A, 132B. Intermediate sprockets 159, 160 are fastened to the middle shaft 158. A driven sprocket 161 is fastened to one end of the camshaft 151. A driven sprocket 162 is fastened to one end of the camshaft 152. A driving sprocket 163 is fastened to both ends of the crankshaft 105. A first cam chain 164 is wound between the sprockets 159, 163. A second cam chain 165 is wound between the sprockets 160-162. These sprockets 159-163 and cam chains 164, 165 are housed in a cam chain chamber 166, which is formed toward one end of the banks 110A, 110B.

The gear ratio between the driving sprocket 163 and driven sprockets 161, 162 is 2. When the crankshaft 105 rotates, the driving sprocket 163 rotates together with the crankshaft 105. The driven sprockets 161, 162 then rotate via the cam chains 164, 165 at half the rotation speed of the crankshaft 105. Thus, the intake valves 147 and exhaust valves 148 open/close the intake ports 145 and exhaust ports 146, respectively, in accordance with the cam profiles of the camshafts 151, 152, which rotate together with the driven sprockets 161, 162.

A power generator (not shown) is attached to the left end of the crankshaft 105. A driving gear (hereinafter referred to as the crank side driving gear) 175, which is positioned inside the right-hand driving sprocket 163 (on the left-hand side of the vehicle body), is fastened to the right end of the crankshaft 105. The crank side driving gear 175 meshes with a driven gear (hereinafter referred to as the intermediate side driven gear) 177, which is mounted on the intermediate shaft 121, transmits the rotation of the crankshaft 105 to the intermediate shaft 121 at a constant speed, and rotates the intermediate shaft 121 at the same speed as the crankshaft 105 and in a direction opposite to the rotation direction of the crankshaft 105.

The intermediate shaft 121 is rotatably supported below the rear of the crankshaft 105 and below the front of the main shaft 123.

An oil pump driving sprocket 181, the aforementioned intermediate side driven gear 177, and a driving gear 182 having a smaller diameter than the driven gear 177 (this driving gear is hereinafter referred to as the intermediate side driving gear) are sequentially mounted on the right end of the intermediate shaft 121.

The oil pump driving sprocket 181 transmits the torque of the intermediate shaft 121 to a driven sprocket 186 via a transmission chain 187 to drive an oil pump 184. The driven sprocket 186 is fastened to a driving shaft 185 for the oil pump 184, which is positioned behind the intermediate shaft 121 and below the main shaft 123.

Further, the intermediate side driving gear 182 meshes with a driven gear (hereinafter referred to as the main side driven gear) 191, which is relatively rotatably mounted on the main shaft 123, and transmits the rotation of the intermediate shaft 121 to the main shaft 123 through a clutch mechanism (not shown) at a reduced speed. In other words, the reduction ratio between the crankshaft 105 and main shaft 123, that is, the primary reduction ratio for the engine 17, is set in accordance with the reduction ratios of the intermediate side driving gear 182 and main side driven gear 191.

The main shaft 123 is rotatably supported above the rear of the crankshaft 105. The countershaft 125 is rotatably supported substantially behind the main shaft 123. Speed change gears (not shown) are disposed over the main shaft 123 and countershaft 125 to form a transmission.

The left end of the countershaft 125 is coupled to a drive shaft (not shown) that extends in the longitudinal direction of the vehicle body. This ensures that the rotation of the countershaft 125 is transmitted to the drive shaft.

Figure 4:
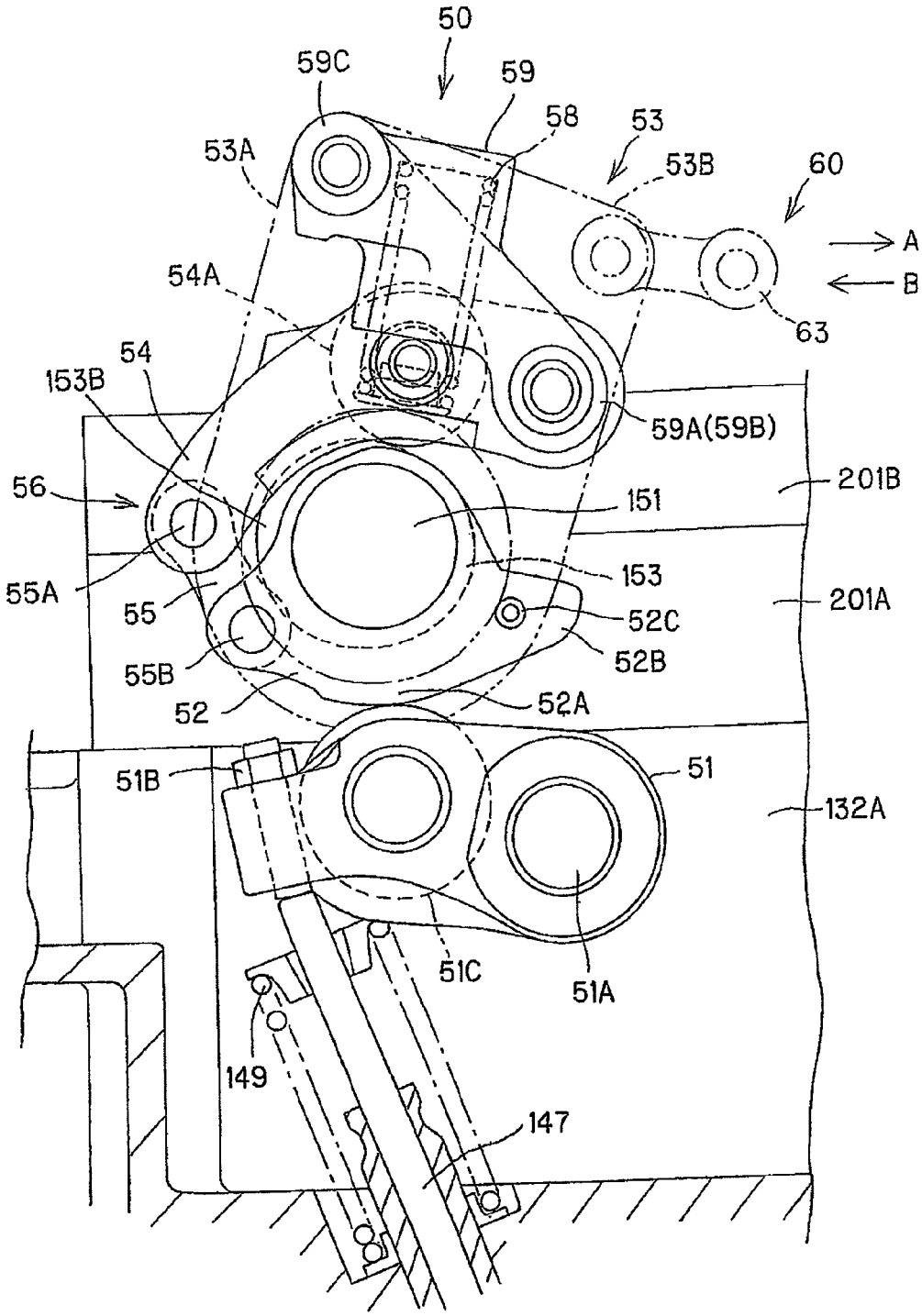
FIG. 4 is a side view of a valve device.
Figure 5:
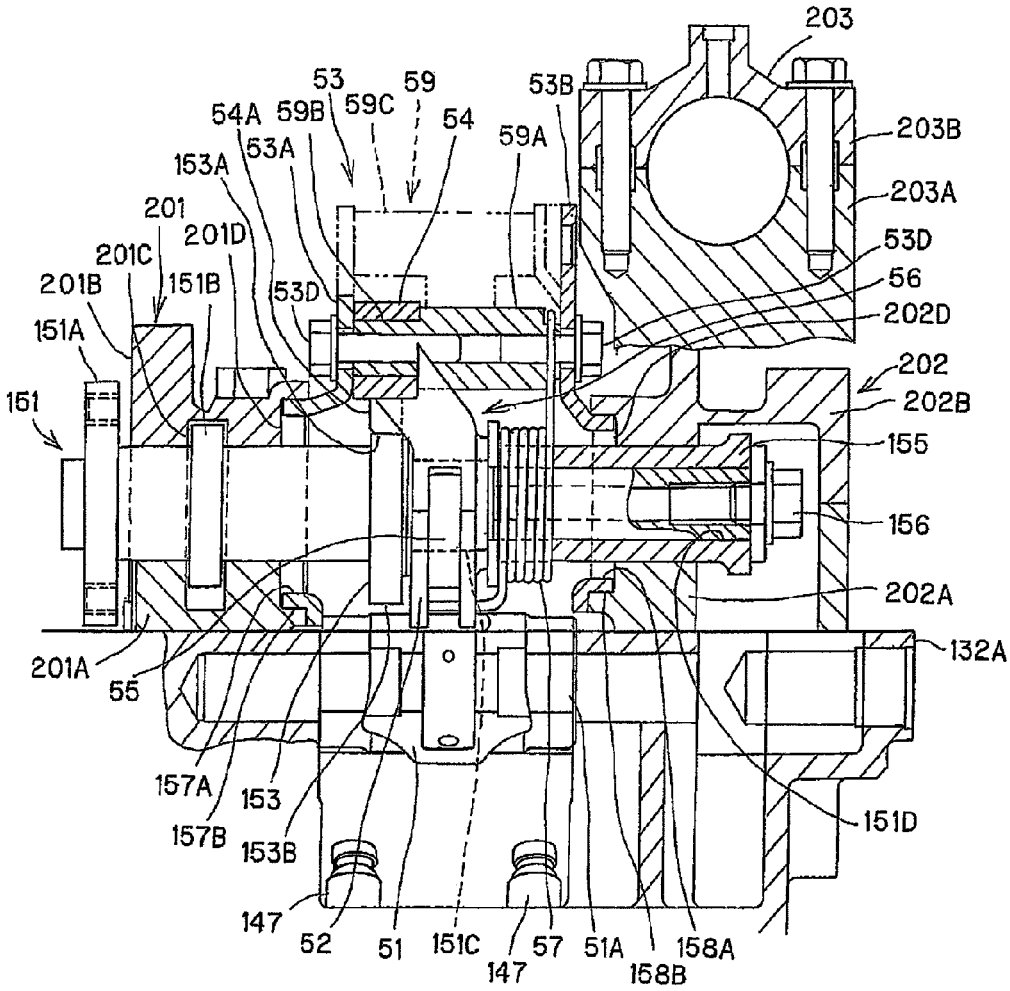
FIG. 5 is a longitudinal cross-sectional view as viewed from the rear showing the valve device of the front bank.

FIG. 4 is a side view of the valve device 50. FIG. 5 is a longitudinal cross-sectional view as viewed from the rear showing the valve device 50 of the front bank 110A.

As shown in FIG. 3, the valve device 50 is configured so that the intake side and exhaust side are independent of each other and symmetric with respect to the cylinder axis line C. The valve device 50 for the front bank 110A has substantially the same structure as the valve device 50 for the rear bank 110B. Therefore, the present embodiment will now be described with reference to the intake side valve device 50 for the front bank 110A.

As shown in FIGS. 4 and 5, the valve device 50 includes the camshaft 151 (or the camshaft 152 on the exhaust side), the intake cam 153 (or the exhaust cam 154 on the exhaust side) which rotates together with the camshaft 151, a rocker arm 51 which opens/closes the intake valve 147 (or the exhaust valve 148 on the exhaust side), a valve cam 52 which is relatively rotatably supported by the camshaft 151 to open/close the intake valve 147 via the rocker arm 51, a holder (holder member) 53 which is swingable around the camshaft 151, a link mechanism 56 which is swingably supported by the holder 53 to transmit the valve driving force of the intake cam 153 to the valve cam 52 and swing the valve cam 52, and a drive mechanism 60 which swings the holder 53. The link mechanism 56 includes a sub-rocker arm 54, which is coupled to the holder 53, and a connect link 55, which swingably couples the sub-rocker arm 54 and valve cam 52.

The rocker arm 51 is wide so that a single rocker arm 51 opens/closes a pair of intake valves 147. One end of the rocker arm 51 is swingably supported by a rocker arm pivot 51A, which is fastened to the cylinder head 132A. The other end of the rocker arm 51 is provided with a pair of adjustment screws 51B, which abuts on the upper end of each intake valve 147. A roller 51C that comes into contact with the valve cam 52 is rotatably supported at the center of the rocker arm 51.

As shown in FIG. 5, one end of the camshaft 151 is provided with a sprocket retention section 151A to which the driven sprocket 161 (see FIG. 2) is fastened. A positioning section 151B, a swing cam support section 151C, and a collar engagement section 151D are sequentially disposed from the side toward the sprocket retention section 151A. The positioning section 151B projects from the outer circumference of the camshaft 151 and has a circular cross section. The swing cam support section 151C swingably supports the intake cam 153 and valve cam 52. The collar engagement section 151D is smaller in diameter than the swing cam support section 151C. A camshaft collar 155, which functions as a bearing for the camshaft 151, is fitted into the collar engagement section 151D. The camshaft collar 155 is pressed toward the valve cam 52 by a lock bolt 156 that is screwed into the other end of the camshaft 151.

Both ends of the camshaft 151 are rotatably supported by camshaft support sections 201, 202. More specifically, the camshaft support sections 201, 202 are configured so that caps 201B, 202B with a support section having a semicircular cross section are respectively fastened to head side support sections 201A, 202A, which are formed above the cylinder head 132A. A groove 201C formed to match the shape of the positioning section 151B is made in the camshaft support section 201 on the side toward the positioning section 151B. The groove 201C restricts the position of the positioning section 151B to ensure that the camshaft 151 is positioned in the axial direction.

The surfaces of the camshaft support sections 201, 202 toward the intake cam 153 are respectively provided with holder support sections 201D, 202D, which support the holder 53.

The valve cam 52 is placed on the swing cam support section 151C, which is positioned on the middle part of the camshaft 151. A base circle portion 52A, which keeps the intake valve 147 closed, a cam lobe portion 52B, which opens the intake valve 147 by pressing it downward, are formed on the valve cam 52 as shown in FIG. 4. A through-hole 52C is formed in the cam lobe portion 52B. One end of a valve cam return spring 57 (see FIG. 5) is attached to the through-hole 52C. The valve cam return spring 57 applies a force to the valve cam 52 in the direction of moving the cam lobe portion 52B away from the roller 51C of the rocker arm 51, that is, in the direction of closing the intake valve 147. As shown in FIG. 5, the valve cam return spring 57 is wound around the camshaft 151. The other end of the valve cam return spring 57 is attached to the holder 53.

The holder 53 includes a first plate 53A and a second plate 53B, which are disposed at a predetermined distance from each other in the axial direction of the camshaft 151 with the intake cam 153 and valve cam 52 positioned in between. The holder 53 also includes a coupling member 59, which couples the first and second plates 53A, 53B in the axial direction of the camshaft 151. The first plate 53A is positioned toward one end to which the driven sprocket 161 of the camshaft 151 is fastened, whereas the second plate 53B is positioned toward the other end of the camshaft 151.

The coupling member 59 includes a shaft portion 59A that is parallel to the camshaft 151. A sub-rocker arm support section 59B (fulcrum) to which one end of the sub-rocker arm 54 is coupled is formed on an end of the shaft portion 59A toward the first plate 53A. The coupling member 59 is fastened to the first and second plates 53A, 53B by a pair of bolts 53D that are inserted into both ends of the shaft portion 59A from the outer surface side of the first and second plates 53A, 53B. Further, the coupling member 59 includes a shaft portion 59C that is parallel to the shaft portion 59A. The coupling member 59 is also fastened to the first and second plates 53A, 53B by a pair of bolts (not shown) that are inserted into both ends of the shaft portion 59C from the outer surface side of the first and second plates 53A, 53B.

The first and second plates 53A, 53B respectively have shaft holes 157A, 158A through which the camshaft 151 passes. The peripheries of the shaft holes 157A, 158A are tonic convexes 157B, 158B that project toward the holder support sections 201D, 202D. The holder 53 is supported and swingable around the camshaft 151 as the convexes 157B, 158B fit into the holder support sections 201D, 202D.

The sub-rocker arm 54 is positioned between the first and second plates 53A, 53B together with the intake cam 153 and valve cam 52. One end of the sub-rocker arm 54 is rotatably supported by the sub-rocker arm support section 59B of the coupling member 59 so that the sub-rocker arm 54 swings around the sub-rocker arm support section 59B. A roller 54A that comes into contact with the intake cam 153 is rotatably supported at the center of the sub-rocker arm 54. One end of the connect link 55 is coupled to the other end of the sub-rocker arm 54 via a pin 55A (see FIG. 4) that swingably supports the connect link 55. The valve cam 52 is coupled to the other end of the connect link 55 via a pin 55B (see FIG. 4) that swingably supports the valve cam 52.

As shown in FIG. 4, a sub-rocker arm return spring 58, which is housed in the coupling member 59, applies a force to the sub-rocker arm 54 so that the roller 54A of the sub-rocker arm 54 is constantly pressed against the intake cam 153. It should be noted that the sub-rocker arm return spring 58 is a coil spring.

The operations will now be described.

Referring to FIG. 4, when the camshaft 151 rotates in the valve device 50 configured as described above, the cam lobe portion 153B of the intake cam 153, which rotates together with the camshaft 151, pushes the sub-rocker arm 54 upward via the roller 54A and swings the sub-rocker arm 54 around the shaft portion 59A. The connect link 55 then rotates the valve cam 52 clockwise around the camshaft 151 as viewed in FIG. 4. The rotation of the valve cam 52 causes the cam lobe portion 52B to push the intake valve 147 downward together with the rocker arm 51 via the roller 51C. The intake valve 147 then opens. When the camshaft 151 further rotates, causing the base circle portion 153A of the intake cam 153 to abut on the roller 54A, the sub-rocker arm return spring 58 pushes the sub-rocker arm 54 downward. At the same time, the valve cam return spring 57 rotates the valve cam 52 counterclockwise as viewed in FIG. 4, thereby causing the base circle portion 52a to abut on the roller 51C. The valve springs 149 (see FIG. 2) then close the intake valve 147 by pushing it upward.

In the valve device 50, a coupling link member 63 is connected to the holder 53 as shown in FIG. 4. When the coupling link member 63 moves in the direction of arrow A, the holder 53 swings clockwise around the axial center of the intake camshaft 151. When the sub-rocker arm support section 59B becomes displaced downward as viewed in FIG. 4 and moves in the direction of arrow B, the holder 53 swings counterclockwise around the axial center of the intake camshaft 151, thereby displacing the sub-rocker arm support section 59B upward as viewed in the FIG. 4.

Thus, the valve device 50 is configured to be able to change the opening/closing operation characteristics of the intake valve 147 and exhaust valve 148.

Figure 6:
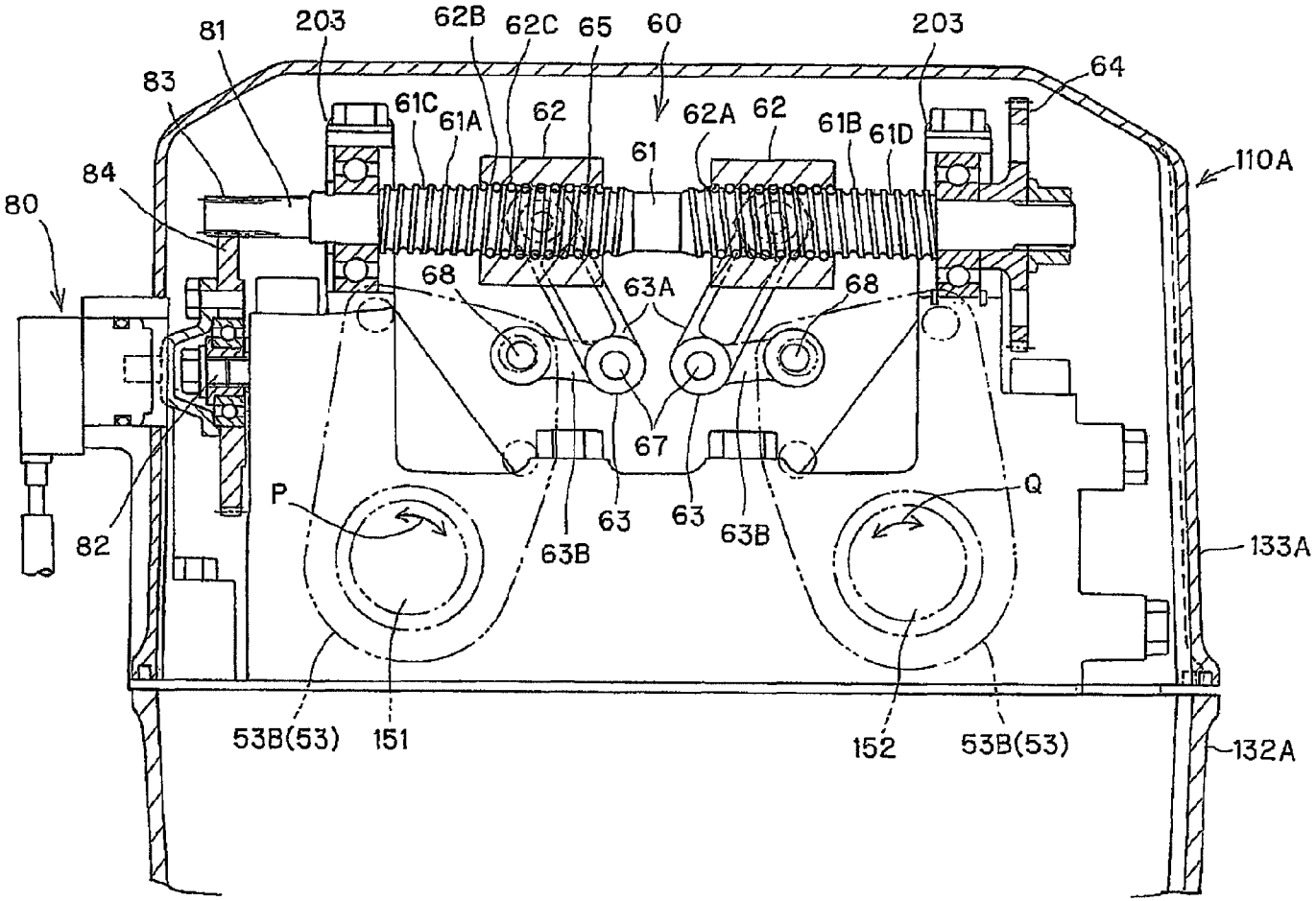
FIG. 6 is a longitudinal cross-sectional side view of a drive mechanism.

The coupling link member 63 is coupled to the drive mechanism 60 as shown in FIG. 6.

Figure 7:
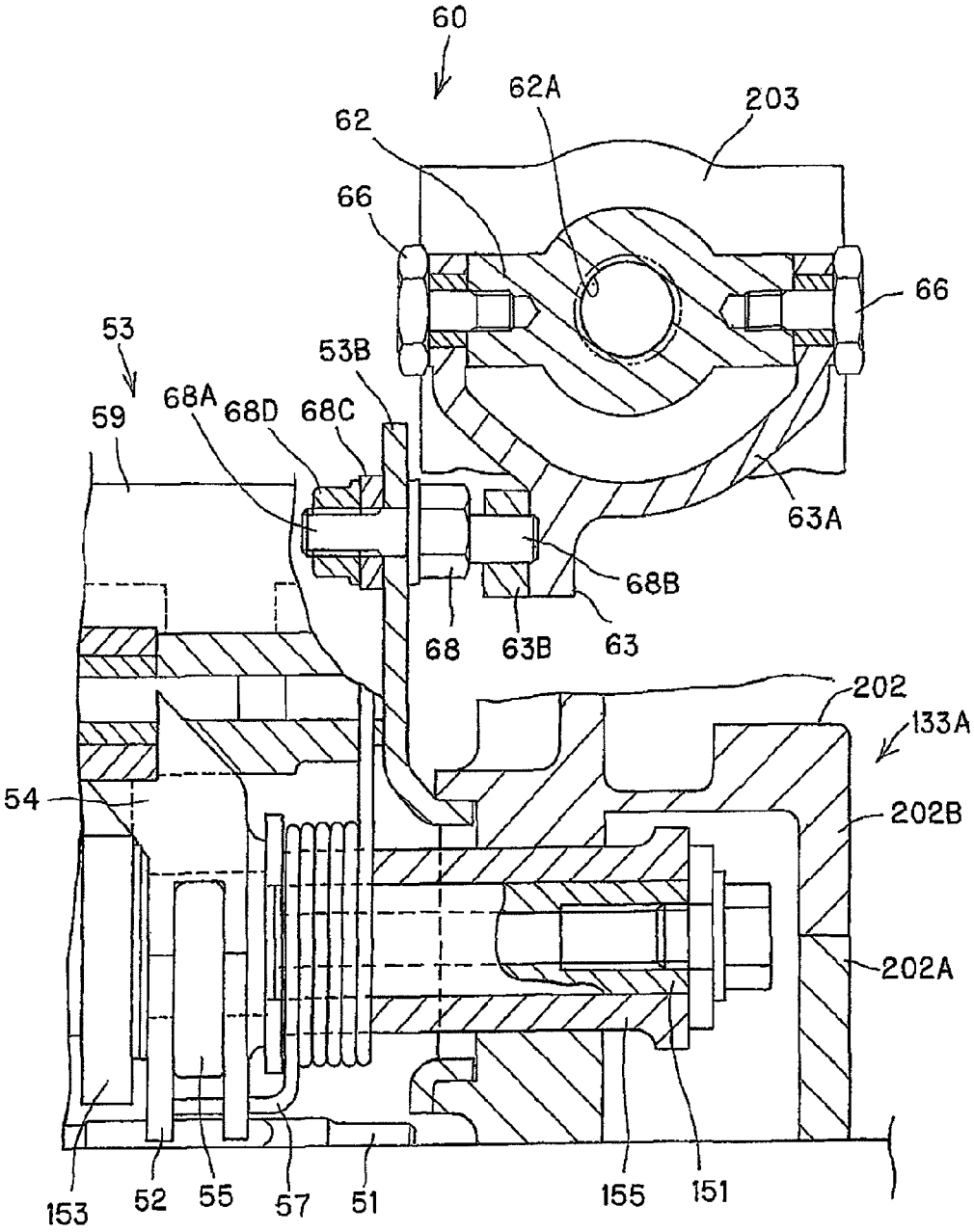
FIG. 7 is a longitudinal cross-sectional front view of the drive mechanism.

FIG. 6 is a longitudinal cross-sectional side view of the drive mechanism 60. FIG. 7 is a longitudinal cross-sectional front view of the drive mechanism 60.

As shown in FIG. 6, the drive mechanism 60 is coupled to the holder 53 via the coupling link member 63. The drive mechanism 60 includes a ball screw 61, which is positioned over the intake camshaft 151 and exhaust camshaft 152, and two nuts 62 (sliders), which are provided for both the intake side and exhaust side and capable of traveling axially along the ball screw 61. The coupling link member 63 is positioned between the nuts 62 and holder 53.

A driven gear 64 is fastened to one exhaust side end of the ball screw 61. An electric actuator (actuator) 70 (see FIG. 8) for rotating the ball screw 61 is coupled to the driven gear 64 with a gear ring train.

The ball screw 61 is perpendicular to the camshafts 151, 152, and positioned toward the other sides of the camshafts 151, 152, that is, positioned opposite the side to which the driven sprockets 161, 162 (see FIG. 2) are fastened. As described above, the ball screw 61 does not extend in the vertical direction of the engine 17, but is positioned over the intake camshaft 151 and exhaust camshaft 152. This makes it possible to keep the height of the engine 17 low. Both ends of the ball screw 61 are rotatably supported by ball screw support sections 203. As shown in FIG. 5, the ball screw support sections 203 are configured so that a cap 203B with a support section having a semicircular cross section is fastened to a camshaft side support section 203A formed on the top of the camshaft support sections 202.

As shown in FIG. 6, helical threads 61A, 61B and helical shaft thread grooves 61C, 61D are respectively formed on the intake and exhaust sides of the outer circumferential surface of the ball screw 61. The helical threads 61A, 61B and helical shaft thread grooves 61C, 61D are configured so that the intake and exhaust sides differ in the direction of threading.

The other intake side end of the ball screw 61 is provided with a sensor 80 that detects the rotation of the ball screw 61. The sensor 80 is fastened to a sidewall positioned inside the V banks of the head cover 133A (133B). As the sensor 80 is positioned inside the V banks as described above, it is possible to reduce the length of the engine 17 in the longitudinal direction of the vehicle body and enclose the sensor 80 with the front bank 110A and rear bank 110B (see FIG. 2).

The sensor 80 includes a rotary shaft 81, which is fastened to the other end of the ball screw 61, and a fixed shaft 82, which is positioned below and substantially parallel to the rotary shaft 81 and provided with a hexagon head screw fastened to a ball screw support section 203. A driving gear 83 is formed on the outer circumferential surface of the rotary shaft 81. A driven gear 84 is formed on the fixed shaft 82 to mesh with the driving gear 83. Therefore, when the ball screw 61 rotates, the rotation of the rotary shaft 81, which rotates together with the ball screw 61, is transmitted to the driven gear 84 via the driving gear 83. The sensor 80 detects the amount of rotation of the ball screw 61 in accordance with the amount of rotation of the driven gear 84.

The nuts 62 are provided with a through-hole 62A through which the ball screw 61 passes. A helical nut thread 62B corresponding to the threads 61A, 61B and a helical nut thread groove 62C corresponding to the shaft thread grooves 61C, 61D are formed on the inner circumferential surface of the through-hole 62A. A plurality of rollable balls 65 are positioned between the nut thread groove 62C and shaft thread grooves 61C, 61D. When the ball screw 61 rotates, the nuts 62 travel along the ball screw 61 via the balls 65.

As shown in FIGS. 6 and 7, the coupling link member 63 includes a nut side link 63A and a holder side link 63B. One end of the nut side link 63A is fastened to the nut 62. The holder side link 63B couples the other end of the nut side link 63A to the second plate 53B.

One end of the nut side link 63A is fastened to the nut 62 with bolts 66 in such a manner that the nut 62 is sandwiched between the bolts 66. The other end of the nut side link 63A is swingably supported by one end of the holder side link 63B via a pin 67. The other end of the holder side link 63B is swingably supported by the second plate 53B via an eccentric pin 68. The eccentric pin 68 includes a hexagon head bolt 68A and an eccentric shaft 68B, which is eccentrically integral with the head of the hexagon head bolt 68A. The hexagon head bolt 68A is fastened to the second plate 53B with a spring washer 68C and a hexagon nut 68D. The eccentric shaft 68B is rotatably supported by the nut side link 63A.

Referring to FIG. 6, when the holder 53 swings in the direction of arrows P and Q, the sub-rocker arm support section 59B of the link mechanism 56 shown in FIG. 4 changes its position. When the position of the sub-rocker arm support section 59B changes, the valve cam 52 swings around the camshaft 151 to circumferentially displace its position relative to the camshaft 151, thereby changing the circumferential phase relative to the intake cam 153, that is, the angular position or circumferential position relative to the intake cam 153. As described above, the period during which the cam lobe portion 52B of the valve cam 52 abuts on the roller 51C and the amount of depression by the cam lobe portion 52B can be changed by changing the circumferential position of the valve cam 52 relative to the intake cam 153. This makes it possible to change the valve opening period and lift amount of the intake valve 147.

When, for instance, the ball screw 61 rotates to move the nut 62 toward the center of the ball screw 61 and the coupling link member 63 further swings the holder 53 clockwise as viewed in FIG. 4, the link mechanism 56 rotates the valve cam 52 clockwise. The rotation of the camshaft 151 in the resulting state increases the period during which the cam lobe portion 52B depresses the roller 51C and the amount of such depression. This increases the valve opening period and lift amount of the intake valve 147.

The electric actuator 70, which varies the valve opening periods and lift amounts of the intake and exhaust valves 147, 148, will now be described.

Figure 8:
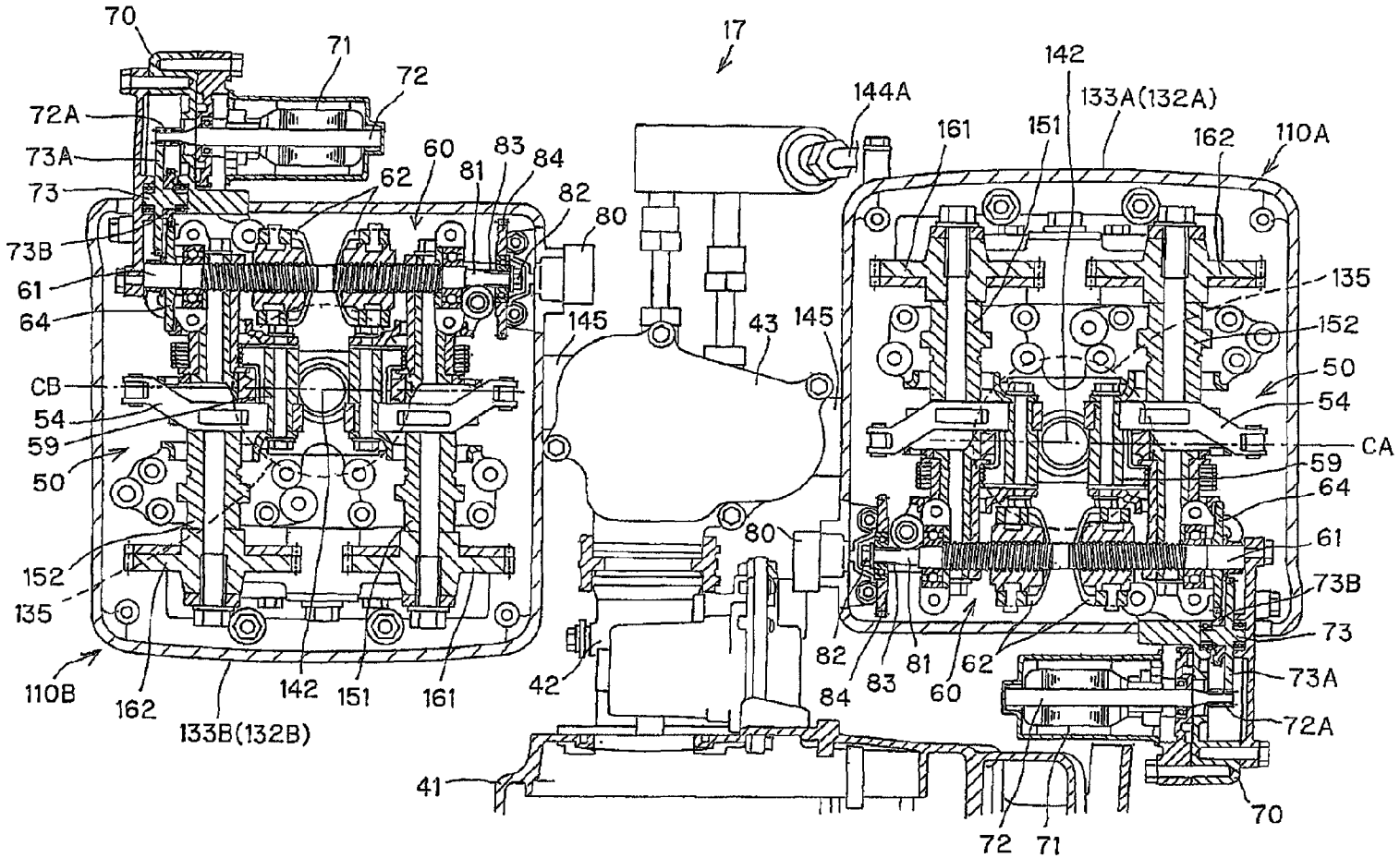
FIG. 8 is a transverse cross-sectional top view of the engine.

FIG. 8 is a transverse cross-sectional top view of the engine 17. FIG. 8 shows the front and rear banks 110A, 110B as viewed along the cylinder axis line C (see FIG. 2) and from above the engine 17.

The cylinder bores 135 of the front and rear banks 110A, 110B are positionally offset from each other in the axial direction of the crankshaft 105 (see FIG. 2), that is, in the axial direction of the camshafts 151, 152, in accordance with the offset in the transverse direction of the vehicle body of the connecting rod 137 (see FIG. 2). More specifically, a cylinder center line CA in the longitudinal direction of the vehicle body of the front bank 110A is offset in the rightward direction of the vehicle body (in the downward direction as viewed in FIG. 8), whereas a cylinder center line CB in the longitudinal direction of the vehicle body of the rear bank 110B is offset in the leftward direction of the vehicle body (in the upward direction as viewed in FIG. 8).

The banks 110A, 110B, which enclose the pair of front and rear cylinder bores 135, are positionally offset from each other in the axial direction of the camshafts 151, 152. More specifically, the front bank 110A is offset in the leftward direction of the vehicle body, whereas the rear bank 110B is offset in the rightward direction of the vehicle body. A space equivalent to the offset amount of the front and rear banks 110A, 110B is formed on the right-hand side of the front bank 110A and on the left-hand side of the rear bank 110B. Such a space is used to mount the electric actuator 70 on a lateral surface positioned opposite the offset direction of the head covers 133A, 133B. More specifically, the electric actuator 70 for the front bank 110A is mounted on the right-hand side of the vehicle body (on the lower side of the vehicle body as viewed in FIG. 8), whereas the electric actuator 70 for the rear bank 110B is mounted on the left-hand side of the vehicle body (on the upper side of the vehicle body as viewed in FIG.

8). The electric actuator 70 is mounted so that its upper surface is positioned below the top surface (not shown) of the head covers 133A, 133B.

The electric actuator 70 is mounted on one exhaust side end of the ball screw 61 and fastened to the sidewalls of the head covers 133A, 133B. The electric actuator 70 includes an electric motor 71, a drive shaft 72 (axis line) for the electric motor 71, and an intermediate shaft 73 to which the driving force of the electric motor 71 is transmitted through the drive shaft 71. The electric motor 71 is positioned so that its drive shaft 72 is substantially parallel to the top surface of the head covers 133A, 133B.

A driving gear 72A is formed on the drive shaft 72. A first intermediate gear 73A, which meshes with the driving gear 72A, and a second intermediate gear 73B, which meshes with the driven gear 64 mounted on the ball screw 61, are fastened to the intermediate shaft 73.

The electric actuator 70, which is configured as described above, is mounted on the lateral surface of the head covers 133A, 133B in such a manner that its upper surface is positioned below the top surface of the head covers 133A, 133B. Therefore, the electric actuator 70 does not protrude above the head covers 133A, 133B. This makes it possible to keep the height of the engine 17 low. Further, the cylinder blocks 131A, 131B are positionally offset from each other in the axial direction of the camshafts 151, 152, and the electric actuator 70 is mounted on the lateral surface positioned opposite the offset direction of the head covers 133A, 133B by making use of the space formed by offsetting. Therefore, the axial protrusion of the camshafts 151, 152 can be minimized.

The electric motor 71 for the electric actuator 70 is positioned so that its drive shaft 72 is substantially parallel to the top surface of the head covers 133A, 133B. Thus, the electric motor 71 is positioned sideways relative to the head covers 133A, 133B. This makes it possible to keep the height of the engine 17 low.

The electric actuator 70 is controlled by an ECU (not shown), which serves as an electronic control unit, to drive the drive mechanism 60 in accordance with the operating conditions of the engine 17, such as the revolution speed and load, and the amount of rotation of the ball screw 61, which is input from the sensor 80, that is, the amount of rotation of the electric motor 71. When the electric actuator 70 is driven, the driving force of the electric motor 71 is transmitted to the ball screw 61 via the driving gear 72A, the first intermediate gear 73A, the second intermediate gear 73B, and the driven gear 64.

According to the present embodiment, the electric actuator 70 is mounted on the lateral surface of the head covers 133A, 133B. Therefore, the electric actuator 70 does not protrude above the head covers 133A, 133B. This makes it possible to keep the height of the engine 17 low. Further, the cylinder blocks 131A, 131B are positionally offset from each other in the axial direction of the camshafts 151, 152, and the electric actuator 70 is mounted on the lateral surface positioned opposite the offset direction of the head covers 133A, 133B by making use of the space formed by offsetting. Therefore, the axial protrusion of the camshafts 151, 152 can be minimized.

Furthermore, the electric actuator 70 is the electric motor 71. The electric motor 71 is mounted on the head covers 133A, 133B with its axis line positioned substantially parallel to the top surface of the head covers 133A, 133B. Therefore, the electric motor 71 is positioned sideways relative to the head covers 133A, 133B. This makes it possible to keep the height of the engine 17 low.

Moreover, according to the present embodiment, the drive mechanism 60 includes the ball screw 61, which is positioned over the intake camshaft 151 and exhaust camshaft 152 and provided with the threads 61A, 61B that correspond to the intake and exhaust sides and differ in the direction of threading; the nut 62, which is provided for both the intake and exhaust sides and capable of traveling along the ball screw 61; and the coupling link member 63, which is positioned between the nut 62 and holder 53. Therefore, the ball screw 61 along which the nut 62 travels is positioned over the intake camshaft 151 and exhaust camshaft 152. This makes it possible to keep the height of the engine 17 even lower.

According to the present embodiment, the drive mechanism 60 of the valve device 50 includes the ball screw 61, which is positioned over the intake camshaft 151 and exhaust camshaft 152 and provided with the threads 61A, 61B that correspond to the intake and exhaust sides and differ in the direction of threading; the nut 62, which is provided for both the intake and exhaust sides and capable of traveling along the ball screw 61; and the coupling link member 63, which is positioned between the nut 62 and holder 53.

However, the present invention is also applicable to a valve device that does not have the above features. More specifically, the present invention can be applied to any valve device 50 that includes the intake and exhaust cams 153, 154, which rotate together with the camshafts 151, 152; the valve cam 52, which rotates relative to the camshafts 151, 152 and opens/closes the intake and exhaust valves 147, 148; the link mechanism 56, which transmits the valve driving force of the intake and exhaust cams 153, 154 to the valve cam 52; the holder 53, which supports the fulcrum of the link mechanism 56 and is capable of swinging around the camshafts 151, 152; and the drive mechanism 60, which swings the holder 53 to vary the fulcrum position of the link mechanism 56; and varies the phase/lift amount of the camshafts 151, 152 in accordance with the swing position of the fulcrum of the link mechanism 56.

Even when the above configuration is employed, it is possible to prevent the electric actuator 70 from protruding above the head covers 133A, 133B and keep the height of the engine 17 low by mounting the electric actuator 70 on the lateral surface of the head covers 133A, 133B. Further, the axial protrusion of the camshafts 151, 152 can be minimized by mounting the electric actuator 70 on the lateral surface positioned opposite the offset direction of the head covers 133A, 133B. In addition, the axial protrusion of the camshafts 151, 152 can be minimized at the outside of the V banks of the engine 17 by positioning the electric actuator 70 close to the inside of the V banks.

While the present invention has been described in conjunction with the presently preferred embodiment, it should be understood that the preferred embodiment is offered by way of example only. Persons of skill in the art will appreciate that variations may be made without departure from the scope and spirit of the present invention. For example, the embodiment described above assumes that the sensor 80 is provided for both the front and rear banks 110A, 110B. Alternatively, however, the sensor 80 may be provided for either the front bank 110A or the rear bank 110B.

Figure 9:
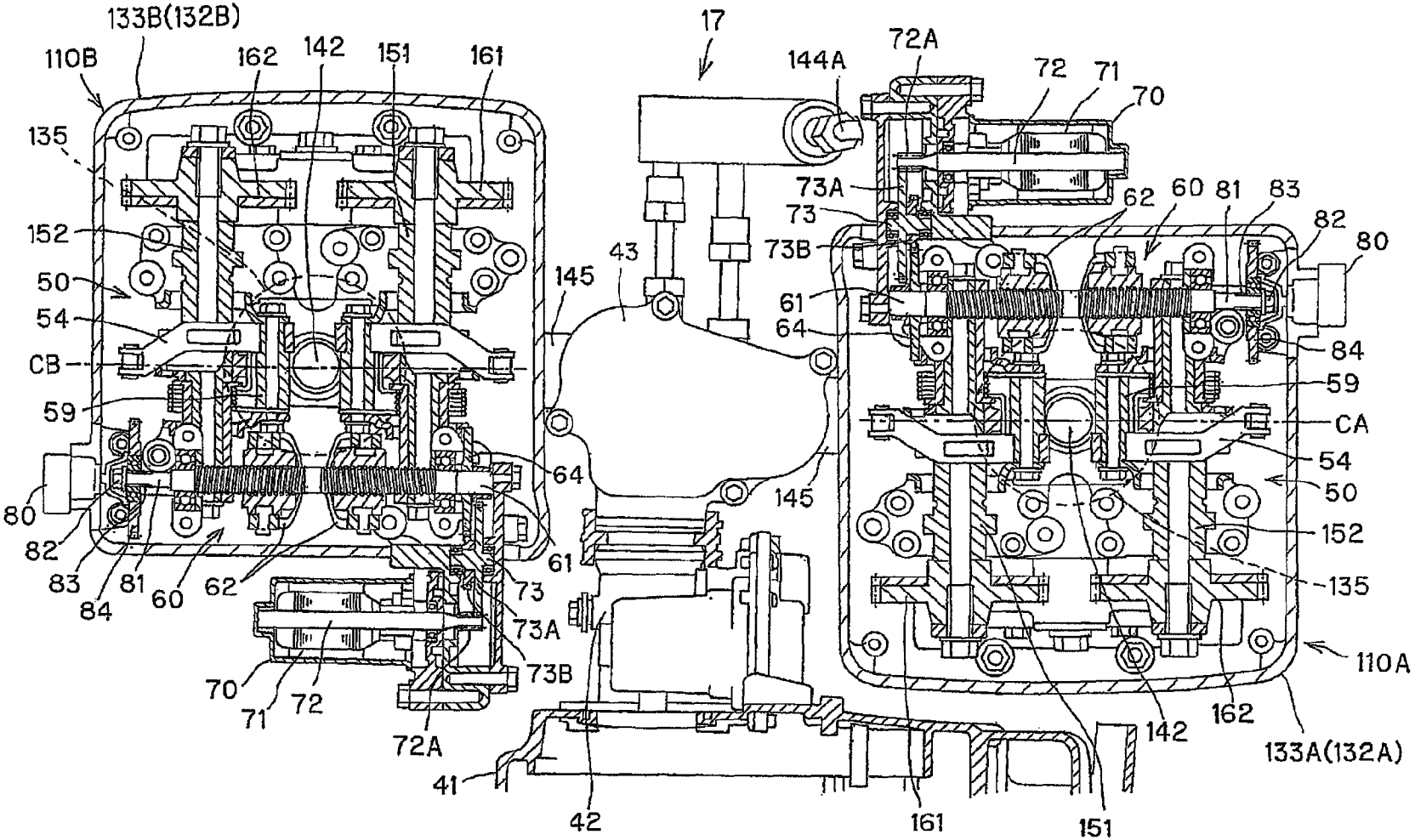
FIG. 9 is a transverse cross-sectional top view of an embodiment of the engine.

As illustrated in FIG. 9, the electric actuator 70 is positioned close to one intake side end of the ball screw 61, that is, the inside of the V banks, and fastened to the sidewalls of the head covers 133A, 133B. As illustrated in FIGS. 8 and 9, the electric actuator 70 includes an electric motor 71, a drive shaft 72 (axis line) for the electric motor 71, and an intermediate shaft 73 to which the driving force of the electric motor 71 is transmitted through the drive shaft 72. The electric motor 71 is positioned so that its drive shaft 72 is substantially parallel to the top surface of the head covers 133A, 133B.

Further, as illustrated in FIG. 9, the electric actuator 70 is positioned close to the inside of the V banks, the axial protrusion of the camshafts 151, 152 can be minimized at the outside of the V banks of the engine 17. In the present embodiment, a seat 30 (see FIG. 1) is positioned immediately behind the rear bank 110B. Vehicle rider's straddling comfort could be adversely affected when the electric actuator 70 is mounted on the lateral surface of the head covers 133A, 133B. However, such an adverse effect can be avoided by shifting the position of the electric actuator 70 for the rear bank 110B in the forward direction.

According to an embodiment of the present embodiment, the electric actuator 70 is mounted on the lateral surface of the head covers 133A, 133B. Therefore, the electric actuator 70 does not protrude above the head covers 133A, 133B. This makes it possible to keep the height of the engine 17 low. Further, as illustrated in FIG. 9, as the electric actuator 70 is positioned close to the inside of the V banks, the axial protrusion of the camshafts 151, 152 can be minimized at the outside of the V banks of the engine 17. This, for example, makes it possible to prevent the electric actuator 70 for the rear bank 110B from interfering with a knee of a motorcycle rider. In addition, as the electric actuator 70 is positioned close to the inside of the V banks, a mass concentration occurs, for instance, to provide the rider of a motorcycle 10 with an improved steering feeling.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A V-type internal combustion engine with a variable valve train which uses an actuator to vary the phase/lift amount of a camshaft, the actuator being mounted on a head cover for each of a plurality of cylinder blocks arranged in a V-shape;

wherein cylinder blocks are positionally offset from each other in the axial direction of the camshaft; and the actuator is mounted on a lateral surface positioned opposite the offset direction of the head cover, wherein the variable valve train includes a drive cam which rotates together with the camshaft, a valve cam which rotates relative to the camshaft and opens/closes an engine valve, a link mechanism which transmits the valve driving force of the drive cam to the valve cam, a holder member which supports a fulcrum of the link mechanism and is capable of swinging around the camshaft, and a drive mechanism which swings the holder member to vary the fulcrum position of the link mechanism, and varies the phase/lift amount of the camshaft in accordance with a swing position of the fulcrum of the link mechanism, wherein the drive mechanism includes a ball screw, which is positioned over an intake camshaft and an exhaust camshaft, the intake side of the ball screw being threaded in one direction and the exhaust side of the ball screw being threaded in another direction;

a slider, which is provided for both the intake side and the exhaust side and capable of traveling along the ball screw; and a coupling link member, which is disposed between the slider and the holder member.

2. The V-type internal combustion engine according to claim 1, wherein the actuator is an electric motor which is mounted on the head cover with the axis line of the electric motor positioned substantially parallel to the top surface of the head cover.

3. A V-type internal combustion engine with a variable valve train which uses an actuator to vary the phase/lift amount of a camshaft, the actuator being mounted on a head cover for each of a plurality of cylinder blocks arranged in a V-shape, wherein the actuator is mounted on a lateral surface of the head cover and positioned close to the inside of a V bank, wherein the cylinder blocks are positionally offset from each other in the axial direction of the camshaft; and the actuator is mounted on a lateral surface positioned opposite the offset direction of the head cover, wherein the variable valve train includes a drive cam which rotates together with the camshaft, a valve cam which rotates relative to the camshaft and opens/closes an engine valve, a link mechanism which transmits the valve driving force of the drive cam to the valve cam, a holder member which supports a fulcrum of the link mechanism and is capable of swinging around the camshaft, and a drive mechanism which swings the holder member to vary the fulcrum position of the link mechanism, and varies the phase/lift amount of the camshaft in accordance with a swing position of the fulcrum of the link mechanism, wherein the drive mechanism includes a ball screw, which is positioned over an intake camshaft and an exhaust camshaft, the intake side of the ball screw being threaded in one direction and the exhaust side of the ball screw being threaded in another direction; a slider, which is provided for both the intake side and the exhaust side and capable of traveling along the ball screw; and a coupling link member, which is disposed between the slider and the holder member.

4. The V-type internal combustion engine according to claim 3, wherein the actuator is an electric motor which is mounted on the head cover with the axis line of the electric motor positioned substantially parallel to the top surface of the head cover.

5. The V-type internal combustion engine according to claim 4, wherein the drive mechanism includes a ball screw, which is positioned over an intake camshaft and an exhaust camshaft, the intake side of the ball screw being threaded in one direction and the exhaust side of the ball screw being threaded in another direction;

a slider, which is provided for both the intake side and the exhaust side and capable of traveling along the ball screw and a coupling link member, which is disposed between the slider and the holder member.

6. A V-type internal combustion engine comprising:

a variable valve train;

an actuator to vary a phase/lift amount of a camshaft, the actuator being mounted on a head cover for each of a plurality of cylinder blocks arranged in a V-shape;

said cylinder blocks being positionally offset from each other in the axial direction of the camshaft; and a lateral surface positioned opposite the offset direction of the head cover, said actuator being mounted on said lateral surface, wherein the variable valve train includes a drive cam for rotating together with the camshaft, a valve cam for rotating relative to the camshaft for opening/closing an engine valve, a link mechanism for transmitting the valve driving force of the drive cam to the valve cam, a holder member for supporting a fulcrum of the link mechanism and being capable of swinging around the camshaft, and a drive mechanism for swinging the holder member to vary the fulcrum position of the link mechanism, and for varying the phase/lift amount of the camshaft in accordance with a swing position of the fulcrum of the link mechanism, wherein the drive mechanism includes a ball screw, which is positioned over an intake camshaft and an exhaust camshaft, the intake side of the ball screw being threaded in one direction and the exhaust side of the ball screw being threaded in another direction;

a slider, which is provided for both the intake side and the exhaust side and capable of traveling along the ball screw; and a coupling link member, which is disposed between the slider and the holder member.

7. The V-type internal combustion engine according to claim 6, wherein the actuator is an electric motor which is mounted on the head cover with the axis line of the electric motor positioned substantially parallel to the top surface of the head cover.

8. The V-type internal combustion engine according to claim 6, wherein the actuator is mounted on a lateral surface of the head cover and positioned close to the inside of a V bank.

* * * * *